US006256829B1

(12) United States Patent
Hatch et al.

(10) Patent No.: US 6,256,829 B1
(45) Date of Patent: Jul. 10, 2001

(54) TELESCOPING BROOM

(76) Inventors: Michael D. Hatch; Robin L. Hatch, both of 16217 S. Denver Ave., Gardena, CA (US) 90248

( * ) Notice: Subject to any disclaimer, the term of this patent is extended or adjusted under 35 U.S.C. 154(b) by 0 days.

(21) Appl. No.: 09/552,791

(22) Filed: Apr. 20, 2000

(51) Int. Cl.[7] ..... A46B 5/00; A47L 13/00; B25G 1/04

(52) U.S. Cl. ..... 15/144.4; 15/144.1

(58) Field of Search ..... 15/144.1, 144.3, 15/144.4, 145, 176.1, 176.6

(56) References Cited

U.S. PATENT DOCUMENTS 1,860,911 * 5/1932 Trimble .
2,792,584 * 5/1957 Fryda .
2,823,404 * 2/1958 Hyman .

FOREIGN PATENT DOCUMENTS

0077869 * 5/1983 (EP) ..... 15/176.1
0246712 * 11/1987 (EP) ..... 15/144.4
0719822 * 2/1932 (FR) ..... 15/176.1
2611566 * 9/1988 (FR) ..... 15/144.4

* cited by examiner

*Primary Examiner*—Randall E. Chin

(57) ABSTRACT

A telescoping broom for providing an extendable and useful sweeping tool. The telescoping broom includes a rectangular shaped support member having a plurality of bristles attached to the bottom thereof and having a longitudinal slot extending in the top and extending through an end thereof with a pair of tracks being disposed in the side walls of the longitudinal slot; and also includes elongate members, a first one of which is pivotally attached in the tracks and has a bore therein for receiving a second one of the elongate members which has a bore therein for receiving a third one of the elongate members; and further includes a handle locking member having a first end portion biasedly extending through an opening in the first end of the first one of the elongate members, and further having a second end portion which extends through a slot in the first one of the elongate members for moving the first end portion; and also includes a pair of handle support members pivotally disposed in the first one of the elongate members and being adapted to be movably received in the tracks.

14 Claims, 2 Drawing Sheets

10
11
12
13
14
15
16
21
22
24
35
36
37
38
39
40

21
22
23
24
25
26
27
28
29
30
31
32

FIG 3
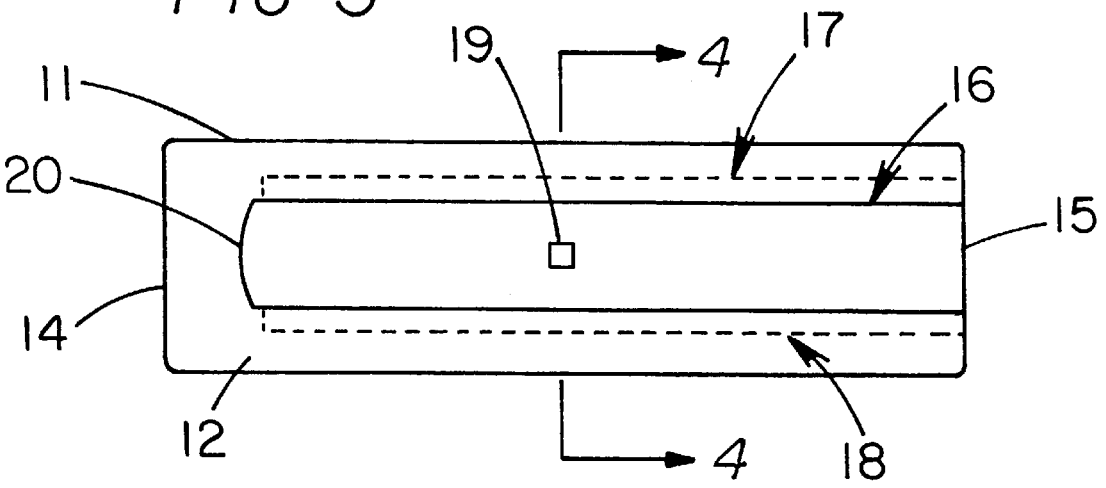
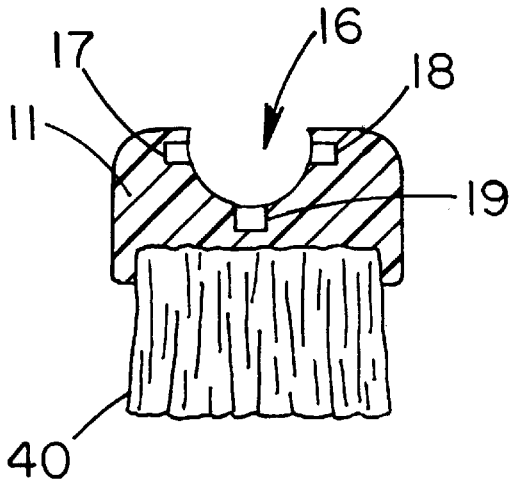
FIG 4
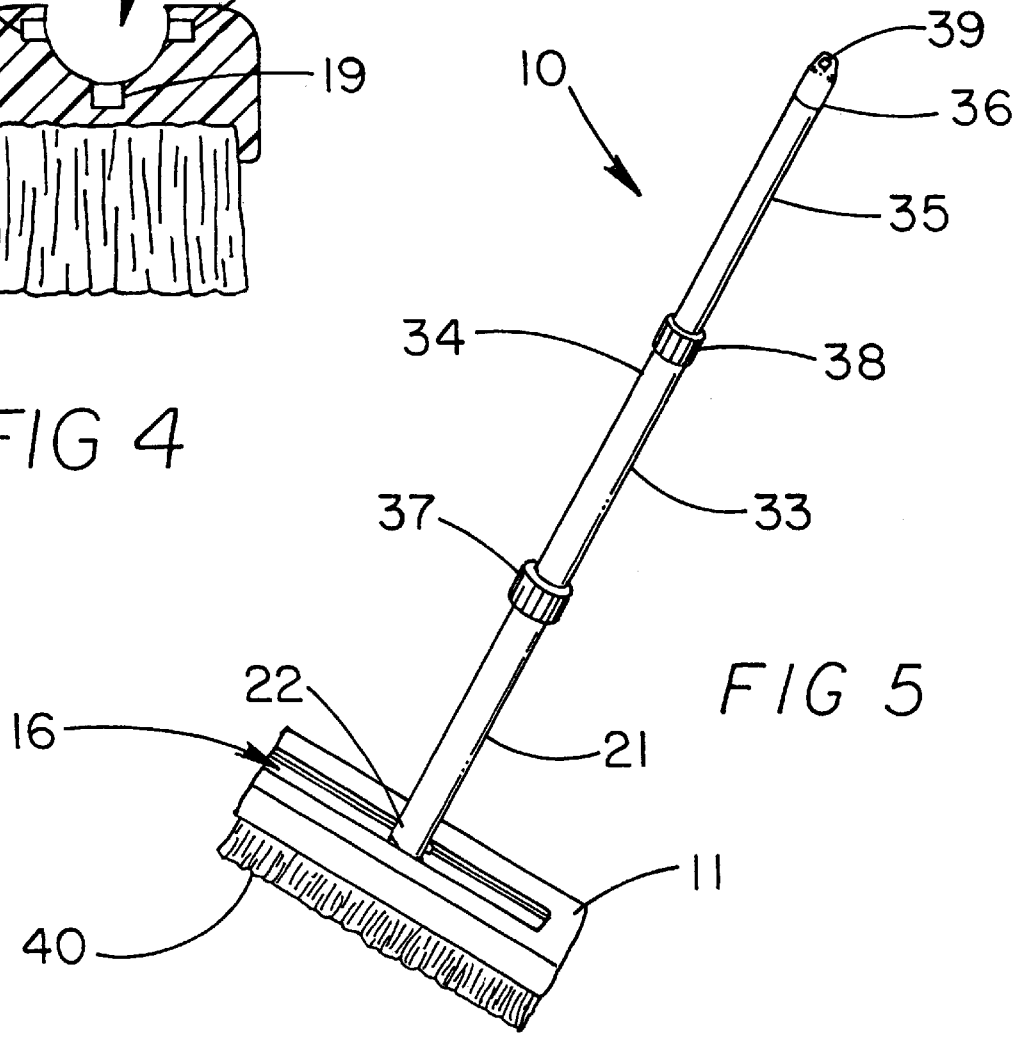
FIG 5

TELESCOPING BROOM

BACKGROUND OF THE INVENTION

1. Field of the Invention

The present invention relates to a collapsible sweeping device and more particularly pertains to a new telescoping broom for providing an extendable and useful sweeping tool.

2. Description of the Prior Art

The use of a collapsible sweeping device is known in the prior art. More specifically a collapsible sweeping device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,661,868; U.S. Pat. No. 3,153,252; U.S. Pat. No. 3,704,479; U.S. Pat. No. 1,185,732; U.S. Pat. No. 3,029,455; and U.S. Pat. No. Des. 364,741.

While these devices fulfill their respective, particular objectives and requirements, the aforementioned patents do not disclose a new telescoping broom. The inventive device includes a rectangular shaped support member having a plurality of bristles attached to the bottom thereof and having a longitudinal slot extending in the top and extending through an end thereof with a pair of tracks being disposed in the side walls of the longitudinal slot; and also includes elongate members, a first one of which is pivotally attached in the tracks and has a bore therein for receiving a second one of the elongate members which has a bore therein for receiving a third one of the elongate members; and further includes a handle locking member having a first end portion biasedly extending through an opening in the first end of the first one of the elongate members, and further having a second end portion which extends through a slot in the first one of the elongate members for moving the first end portion; and also includes a pair of handle support members pivotally disposed in the first one of the elongate members and being adapted to be movably received in the tracks.

In these respects, the telescoping broom according to the present invention substantially departs from the conventional concepts and designs of the prior art, and in so doing provides an apparatus primarily developed for the purpose of providing an extendable and useful sweeping tool.

SUMMARY OF THE INVENTION

In view of the foregoing disadvantages inherent in the known types of collapsible sweeping device now present in the prior art, the present invention provides a new telescoping broom construction wherein the same can be utilized for providing an extendable and useful sweeping tool.

The general purpose of the present invention, which will be described subsequently in greater detail, is to provide a new telescoping broom which has many of the advantages of the collapsible sweeping device mentioned heretofore and many novel features that result in a new telescoping broom which is not anticipated, rendered obvious, suggested, or even implied by any of the prior art collapsible sweeping device, either alone or in any combination thereof.

To attain this, the present invention generally comprises a rectangular shaped support member having a plurality of bristles attached to the bottom thereof and having a longitudinal slot extending in the top and extending through an end thereof with a pair of tracks being disposed in the side walls of the longitudinal slot; and also includes elongate members, a first one of which is pivotally attached in the tracks and has a bore therein for receiving a second one of the elongate members which has a bore therein for receiving a third one of the elongate members; and further includes a handle locking member having a first end portion biasedly extending through an opening in the first end of the first one of the elongate members, and further having a second end portion which extends through a slot in the first one of the elongate members for moving the first end portion; and also includes a pair of handle support members pivotally disposed in the first one of the elongate members and being adapted to be movably received in the tracks.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new telescoping broom which has many of the advantages of the collapsible sweeping device mentioned heretofore and many novel features that result in a new telescoping broom which is not anticipated, rendered obvious, suggested, or even implied by any of the prior art collapsible sweeping device, either alone or in any combination thereof.

It is another object of the present invention to provide a new telescoping broom which may be easily and efficiently manufactured and marketed.

It is a further object of the present invention to provide a new telescoping broom which is of a durable and reliable construction.

An even further object of the present invention is to provide a new telescoping broom which is susceptible of a low cost of manufacture with regard to both materials and labor, and which accordingly is then susceptible of low prices of sale to the consuming public, thereby making such telescoping broom economically available to the buying public.

Still yet another object of the present invention is to provide a new telescoping broom which provides in the apparatuses and methods of the prior art some of the advantages thereof, while simultaneously overcoming some of the disadvantages normally associated therewith.

Still another object of the present invention is to provide a new telescoping broom for providing an extendable and useful sweeping tool.

Yet another object of the present invention is to provide a new telescoping broom which includes a rectangular shaped support member having a plurality of bristles attached to the bottom thereof and having a longitudinal slot extending in the top and extending through an end thereof with a pair of tracks being disposed in the side walls of the longitudinal slot; and also includes elongate members, a first one of which is pivotally attached in the tracks and has a bore therein for receiving a second one of the elongate members which has a bore therein for receiving a third one of the elongate members; and further includes a handle locking member having a first end portion biasedly extending through an opening in the first end of the first one of the elongate members, and further having a second end portion which extends through a slot in the first one of the elongate members for moving the first end portion; and also includes a pair of handle support members in the first one of the elongate members and being adapted to be movably received in the tracks.

Still yet another object of the present invention is to provide a new telescoping broom that provides two cleaning tools in one.

Even still another object of the present invention is to provide a new telescoping broom that is very versatile and easy to use and store.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top plan view of the support member of the present invention.

FIG. 4 is a cross-sectional view of the support member of the present invention.

FIG. 5 is a perspective view of the present invention in an operable position.

DESCRIPTION OF THE PREFERRED EMBODIMENT

Figure 1:
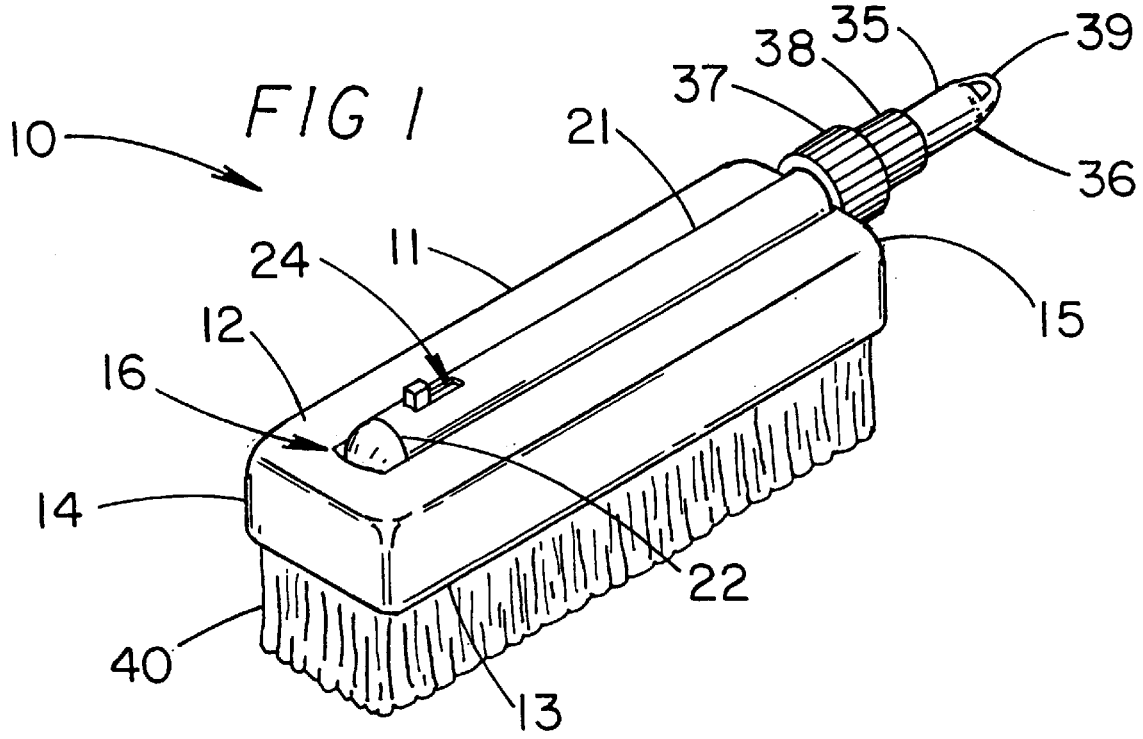
FIG. 1 is a perspective view of a new telescoping broom according to the present invention and being in a stored collapsed position.
Figure 2:
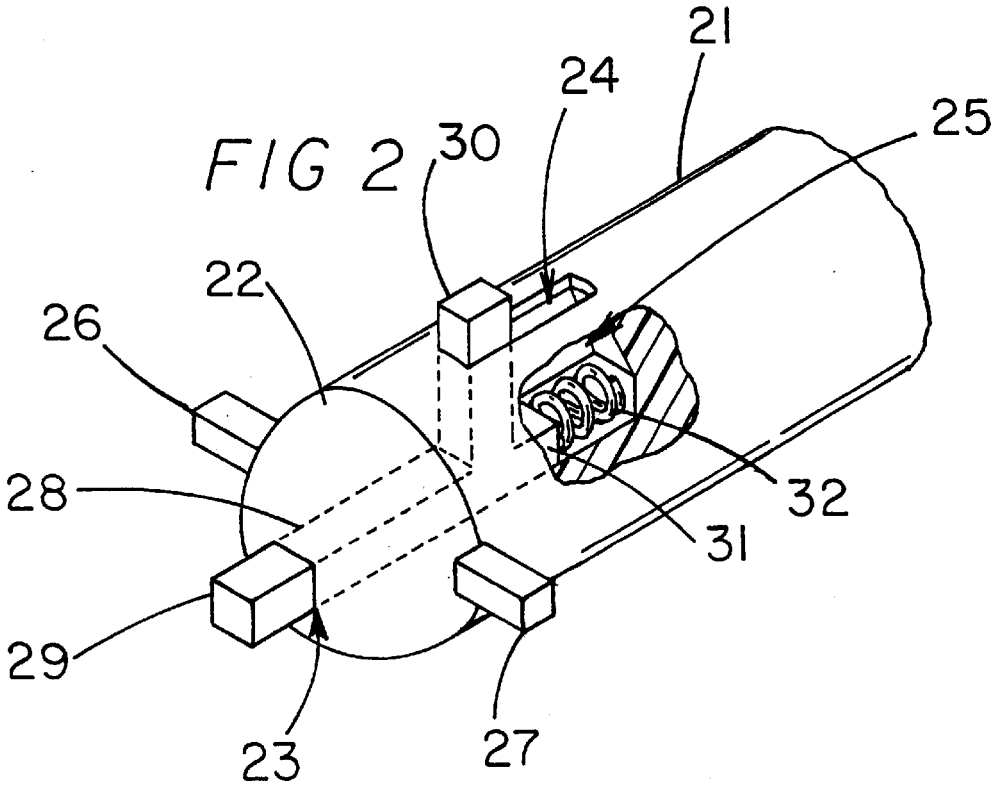
FIG. 2 is a detailed sectioned-out view of the handle means of the present invention.

With reference now to the drawings, and in particular to FIGS. 1 through 5 thereof, a new telescoping broom embodying the principles and concepts of the present invention and generally designated by the reference numeral 10 will be described.

As best illustrated in FIGS. 1 through 5, the telescoping broom 10 generally comprises a support member 11 having a top 12, a bottom 13, ends 14,15, and a longitudinal slot 16 extending in the top 12 and having side walls. The support member 11 further has a pair of tracks 17,18 extending in the side walls of the longitudinal slot 16 with the longitudinal slot 16 extending through one of the ends 15 of the support member 11 and terminating near the other 14 of the ends of the support member 11. Each of the tracks 17,18 extends a length of the longitudinal slot 16 and is a recessed portion extending in a respective one of the side walls of the longitudinal slot 16. The support member 11 further includes a first hole 19 centrally-disposed in a bottom of the longitudinal slot 16 and also including a second hole 20 which is disposed in an end wall of the longitudinal slot 16 with the support member 11 being essentially rectangular shaped with rounded corners.

A plurality of cleaning members 40 are securely and conventionally attached to the bottom 13 of the support member 11 and extend outwardly therefrom with the cleaning members 40 being essentially bristles.

A handle means for manipulating the support member 11 includes a plurality of elongate members 21,33,35, a first one 21 of which includes a first end 22 which is securely, movably disposed in the longitudinal slot 16 and of which further includes an open second end and a bore 25 extending therein, a second one 33 of the elongate members having an open second end 34 and a bore extending therein and being adapted to be slidably received in and extended from the first one 21 of the elongate members, and a third one 35 of the elongate members having a second end 36 and being adapted to be slidably received in and extended from the second one 33 of the elongate members. The first one 21 of the elongate members further has an opening 23 through the first end 22 and has a slot 24 extending through a side wall near the first end 22 thereof. The handle means further includes a pair of handle support members 26,27 in and extending outwardly from the first one 21 of the elongate members and each being adapted to be movably received in a respective one of the tracks 17,18 with the handle support members 26,27 being generally diametrically opposed relative to the first one 21 of the elongate members. The handle means also includes a handle locking member 28 movably disposed in the first one 21 of the elongate members at the first end 22 thereof. The handle locking member 28 has a first end portion 29 biasedly extending through the opening 23 of the first end 22 and also having a second end portion 30 which extends through the slot 24 in the first one 21 of the elongate members and which is movable by a user. The handle locking member 28 further has a third end portion 31 which is securely disposed inside the first one 21 of the elongate members. The handle means further includes a spring 32 disposed inside the first one 21 of the elongate members and biasing against the third end portion 31 of the handle locking member 28. The first end portion 29 of the locking member is removably and biasedly received in the second hole 20 when the elongate members 21,33,35 are in a stored position with the first one 21 of the elongate members being removably received in the longitudinal slot 16 and being removably and biasedly received in the first hole 19 when the elongate members 21,33,35 are extended and in an operable position. The handle means also includes a plurality of elongate member locking members 37,38 for locking the elongate members 21,33,35 in extended operable positions, one of the elongate member locking members 37 being conventionally disposed at the second end of the first one 21 of the elongate members for engaging and securing the second one 33 of the elongate members relative to the first one 21 of the elongate members and another of the elongate member locking members 38 being disposed at the second end 34 of the second one 33 of the elongate members for engaging and securing the third one 35 of the elongate members relative to the second one 33 of the elongate members. The handle means further includes an eyelet 39 securely and conventionally attached to the second end 36 of the third one 35 of the elongate members for hanging and storing the broom 10 to a wall structure with each of the elongate member locking members 37,38 being essentially a threaded collar.

In use, the telescoping broom 10 can be stored in a very compact manner with the elongate members 21,33,35 being removably received in the longitudinal slot 16 with only a second end portion 36 of the third one 35 of the elongate members being extended outwardly from one end 15 of the support member 11. To use the telescoping broom 10, the user can pivot the elongate members 21,33,35 generally perpendicular to the top 12 of the support member 11 and move the elongate members 21,33,35 such that the first end portion 29 of the handle locking member 28 is biasedly received in the first hole 19 in the longitudinal slot 16, and the user can extend the elongate members 21,33,35 relative to one another such that the length of the extended elongate members 21,33,35 would be approximately 50 inches allowing the user to move the bristles 40 upon a floor surface for cleaning.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and chances will readily occur to those skilled in the art, it is not desired to limit the invention to the exact construction and operation shown and described, and accordingly, all suitable modifications and equivalents may be resorted to, falling within the scope of the invention.

We claim:

1. A broom comprising:

a support member having a top, a bottom, ends, and a longitudinal slot extending in said top and having side walls, said support member further having a pair of tracks extending in said side walls of said longitudinal slot, said longitudinal slot extending through one of said ends of said support member and terminating near the other of said ends of said support member;

a plurality of cleaning, members securely attached to said bottom of said support member and extending outwardly therefrom; and a handle means for mounted on said support member for manipulating said support member;

wherein each of said tracks extends at least three-fourths of a length of said longitudinal slot and is a recessed portion extending in a respective one of said side walls of said longitudinal slot.

2. A broom as described in claim 1, wherein said support member further includes a first hole centrally-disposed in a bottom of said longitudinal slot and also includes a second hole which is disposed in an end wall of said longitudinal slot.

3. A broom as described in claim 2, wherein said plurality or elongate members includes a first member having a first end which is securely and movably disposed in said longitudinal slot and of which further includes an open second end and a bore extending therein, a second one of said elongate members having an open second end and a bore extending therein and being adapted to be slidably received in and extended from said first one of said elongate members, and a third one of said elongate members having a second end and being adapted to be slidably received in and extended from said second one of said elongate members, said first one of said elongate members further having an opening through said first end and having a slot extending through a side wall near said first end thereof.

4. A broom as described in claim 3, wherein said handle means further includes a spring disposed inside said first one of said elongate members and biasing against said third end portion of said locking member.

5. A broom as described in claim 1, wherein said handle means further includes a pair of handle support members disposed in and extending outwardly from said first one of said elongate members and each being adapted to be movably received in a respective one of said tracks, said handle support members being generally diametrically opposed relative to said first one of said elongate members.

6. A broom as described in claim 1, wherein said handle means also includes a handle locking member movably disposed in said first one of said elongate members at said first end thereof, said handle locking member having a first end portion biasedly extending through said opening of said first end and also having a second end portion which extends through said slot in said first one of said elongate members and which is movable by a user, said handle locking member further having a third end portion which disposed inside said first one of said elongate members.

7. A broom as described in claim 6, wherein said first end portion of said locking member being removably and biasedly received in said second hole with said first one of said elongate members being removably received in said longitudinal slot when said elongate members are in a stored position and being removably and biasedly received in said first hole when said elongate members are extended and in an operable position.

8. A broom as described in claim 1, wherein one of said plurality of elongate members being disposed at said second end of said first one of said elongate members for engaging and securing said second one of said elongate members relative to said first one of said elongate members and another of said elongate member locking members being disposed at said second end of said second one of said elongate members for engaging and securing said third one of said elongate members relative to said second one of said elongate members.

9. A broom as described in claim 8, wherein said handle means further includes an eyelet securely attached to said second end of said third one of said elongate members for hanging and storing said broom to a wall structure.

10. A broom as described in claim 9, wherein each of said elongate member locking members is essentially a threaded collar.

11. A broom as described in claim 1, wherein said cleaning members are essentially bristles.

12. A broom as described in claim 1, wherein said support member is essentially rectangular shaped with rounded corners.

13. A telescoping broom comprising:

a support member having a top, a bottom, ends, and a longitudinal slot extending in said top and having side walls, said support member further having a pair of tracks extending in said side walls of said longitudinal slot, said longitudinal slot extending through one of said ends of said support member and terminating near the other of said ends of said support member, each of said tracks extending a length of said longitudinal slot and being a recessed portion extending in a respective one of said side walls of said longitudinal slot, said support member further including a first hole centrally-disposed in a bottom of said longitudinal slot and also including a second hole which is disposed in an end wall of said longitudinal slot, said support member being essentially rectangular shaped with rounded corners;

a plurality of cleaning members securely attached to said bottom of said support member and extending outwardly therefrom, said cleaning members being essentially bristles; and a handle means for manipulating said support member including a plurality of elongate members, a first one of which includes a first end which is securely and movably disposed in said longitudinal slot and of which further includes an open second end and a bore extending, therein, a second one of said elongate members having an open second end and a bore extending therein and being adapted to be slidably received in and extended from said first one of said elongate members, and a third one of said elongate members having a second end and being adapted to be slidably received in and extended from said second one of said elongate members, said first one of said elongate members further having an opening through said first end and having a slot extending through a side wall near said first end thereof, said handle means further including a pair of handle support members pivotally disposed in and extending outwardly from said first one of said elongate members and each being adapted to be movably received in a respective one of said tracks, said handle support members being generally diametrically opposed relative to said first one of said elongate members, said handle means also including a handle locking member movably disposed in said first one of said elongate members at said first end thereof, said handle locking member having a first end portion biasedly extending through said opening of said first end and also having a second end portion which extends through said slot in said first one of said elongate members and which is movable by a user, said handle locking member further having a third end portion which disposed inside said first one of said elongate members, said handle means further including a spring disposed inside said first one of said elongate members and biasing against said third end portion of said locking member, said first end portion of said locking member being removably and biasedly received in said second hole with said first one of said elongate members being removably received in said longitudinal slot when said elongate members are in a stored position and being removably and biasedly received in said first hole when said elongate members are extended and in an operable position, said handle means also including a plurality of elongate member locking members for locking said elongate members in extended operable positions, one of said elongate member locking members being disposed at said second end of said first one of said elongate members for engaging and securing said second one of said elongate members relative to said first one of said elongate members and another of said elongate member locking members being disposed at said second end of said second one of said elongate members for engaging and securing said third one of said elongate members relative to said second one of said elongate members, said handle means further including an eyelet securely attached to said second end of said third one of said elongate members for hanging and storing said broom to a wall structure, each of said elongate member locking members being essentially a threaded collar.

14. A collapsible broom comprising:

a support member having a top, a bottom, and opposite ends, a longitudinal slot extending longitudinally along said top, said longitudinal slot having side walls, said support member further having a pair of tracks, wherein each of said tracks is a recessed portion extending in a respective one of said side walls of said longitudinal slot, each of said tracks extending longitudinally along said slot, said longitudinal slot having at least one end wall;

a plurality of cleaning members mounted on said bottom of said support member and extending outwardly therefrom; and a handle mounted on said support member, said handle having opposite ends, a first one of said ends of said handle being pivotally mounted on said support member such that said handle is pivotable between a first position oriented substantially parallel to said longitudinal slot and a second position oriented substantially perpendicular to said longitudinal slot;

wherein a length of said handle is telescopically adjustable between a retracted condition and an extended condition, said handle being positionable in said first position and said second position when said handle is in said retracted condition and said extended condition;

wherein said handle has a pair of handle support members extending outwardly from a first one of said opposite ends of said handle, each of said handle support members being slidably received in one of said tracks of said support member to permit movement of said first end of said handle along said longitudinal slot and permit pivoting of said handle with respect to said support member; and wherein said support member further includes a first hole disposed in a bottom of said longitudinal slot and a second hole disposed in the end wall of said longitudinal slot, and wherein said handle has a handle locking member mounted in a bore in said first end of said handle, said handle locking member being movably inwardly into said bore and being biased outwardly from said bore by a spring for selectively engaging one of said first and second holes of said longitudinal slot, wherein engagement of said handle locking member with said first hole secures said handle in said first position, and wherein engagement of said handle locking member with said second hole secures said handle in said second position.

* * * * *